United States Patent [19]

Kane

[11] 4,282,893

[45] Aug. 11, 1981

[54] CLEANING DEVICE FOR SWIMMING POOLS

[76] Inventor: Robert J. Kane, 5035 N. 12th St., Phoenix, Ariz. 85011

[21] Appl. No.: 141,898

[22] Filed: Apr. 21, 1980

[51] Int. Cl.[3] ..... B08B 9/08; B08B 3/02

[52] U.S. Cl. ..... 134/167 R; 4/490; 15/1.7

[58] Field of Search ..... 134/167 R, 167 C, 168 R, 134/168 C; 15/1.7; 4/490

[56] References Cited

U.S. PATENT DOCUMENTS

| | | | |
|---|---|---|---|
| 3,392,738 | 7/1968 | Pansini | 134/167 R |
| 3,820,172 | 6/1974 | Kane | 4/490 |
| 3,921,654 | 11/1975 | Pansini | 134/167 R |
| 4,178,949 | 12/1979 | Mazon | 134/167 R |

FOREIGN PATENT DOCUMENTS

| | | | |
|---|---|---|---|
| 469798 | 7/1975 | U.S.S.R. | 134/167 C |
| 487682 | 1/1976 | U.S.S.R. | 134/167 C |

*Primary Examiner*—Robert L. Bleutge
*Attorney, Agent, or Firm*—Warren F. B. Lindsley

[57] ABSTRACT

A cleaning device for swimming pools comprising a specially shaped propelling head attached at the end of a flexible hose supplied by water under pressure. Water ejected rearwardly through ports surrounding the attachment of the head to the hose drives the head forward. The whipping action of the hose encouraged by jets spaced along the length of the hose produces a random trajectory over the entire bottom of the pool so that effective agitation and cleaning is achieved over the total pool area.

10 Claims, 12 Drawing Figures

CLEANING DEVICE FOR SWIMMING POOLS

BACKGROUND OF THE INVENTION

The typical home swimming pool installation utilizes a filter unit mounted external to the pool itself through which the water from the pool is circulated to remove accumulations of dust, dirt and other foreign matter. If the pool is in constant use by a number of persons, such foreign matter is picked up by the well agitated water and carried through the drain to the pump and filter unit to permit an effective cleaning operation.

In the typical installation, however, there is not sufficient agitation on a continuing basis to maintain the cleaning function and the foreign matter which accumulates on the bottom of the pool must be stirred up either manually or automatically or it must be removed frequently by using an underwater vacuum apparatus.

Various types of automatic cleaning devices are in use. One type utilizes a plurality of hoses distributed about the periphery of the pool through which water under pressure is discharged into the pool. The hoses whip back and forth along the bottom of the pool to provide the desired agitation. Another type utilizes a carrier which moves about the surface of the pool carrying with it two or more hoses which again discharge water at the bottom of the pool to produce the agitation. The carrier is typically propelled by water under pressure from a special pump, and by virtue of the travel of the carrier unit, the two or more hoses associated with the carrier may be utilized to service the entire pool. Yet another type of automatic cleaner utilizes a single hose which delivers water under pressure to an underwater unit. The underwater unit moves about over the floor of the pool being propelled by the pressurized water which it discharges as it moves along.

While all of the foregoing automatic means serve the intended purpose in varying degrees of effectiveness, each is characterized either by excessive complexity and cost or by inconvenience or inadequate coverage of the entire pool surface. The need still exists, therefore, for an improved automatic means for cleaning a pool through the use of a simple, effective and inexpensive means for stirring up accumulated foreign matter at the floor of the pool so that it may be removed from the water by the pool filter.

DESCRIPTION OF THE PRIOR ART

U.S. Pat. No. 3,392,738 discloses a swimming pool cleaner having a hose with a terminal cleaning nozzle for free movement along the bottom of a swimming pool. The cleaner is provided with a jet nozzle transporting means adapted to move the hose first in one direction and then in another direction to prevent stalling of the hose against submerged pool surfaces.

U.S. Pat. No. 3,820,172 discloses a flexible sweep hose for use in swimming pools for cleaning purposes which are provided with specially constructed high velocity, multijet cleaning nozzles at their outer ends and a plurality of long lasting adjustably positioned wear rings surrounding the flexible hoses in strategic locations to prevent excessive hose wear.

U.S. Pat. No. 3,921,654 discloses an automatic cleaner for swimming pools which is adapted to be connected to a source of fluid under pressure and when under the influence of the pressurized fluid to move in a random manner about the pool to perform the cleaning process. The cleaner is set forth as being of a particular geometrical configuration.

U.S. Pat. No. 4,178,949 discloses rotating wear rings disposed along a flexible whip hose of the type used for cleaning swimming pools.

SUMMARY OF THE INVENTION

In accordance with the invention claimed, an improved automatic cleaning device is provided for use in cleaning a swimming pool. The device comprises a special self-propelling discharge head attached at the end of a pressurized water hose. The discharge head moves vigorously about over substantially the entire floor of the pool producing an effective agitating action which stirs up accumulated foreign matter allowing it to be carried to the filter unit for removal.

It is therefore one object of this invention to provide a new and improved cleaning device for a swimming pool which operates in conjunction with the pool filter and pump to aid in the removal of dust, dirt and other accumulated foreign matter.

Another object of this invention is to provide such a cleaning device which is propelled about over the entire under water surface of the pool where such foreign matter has a tendency to collect.

A further object of this invention is to provide such a device which characteristically maintains a position on the bottom of the pool as it traverses the pool area.

A still further object of this invention is to provide such a device in a form which utilizes no moving parts for propulsion or guidance so that it will remain trouble and maintenance free throughout its operating life.

A still further object of this invention is to provide such a device which is inherently simple in form and which may readily be fabricated from inexpensive materials at a low manufacturing cost.

A still further object of this invention is to provide such a device which is convenient in its use with a capability for quick and easy installation and removal.

Yet another object of this invention is to provide such a device in a form which utilizes only a single simple propelling head at the end of one hose to clean an entire pool.

Further objects and advantages of this invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
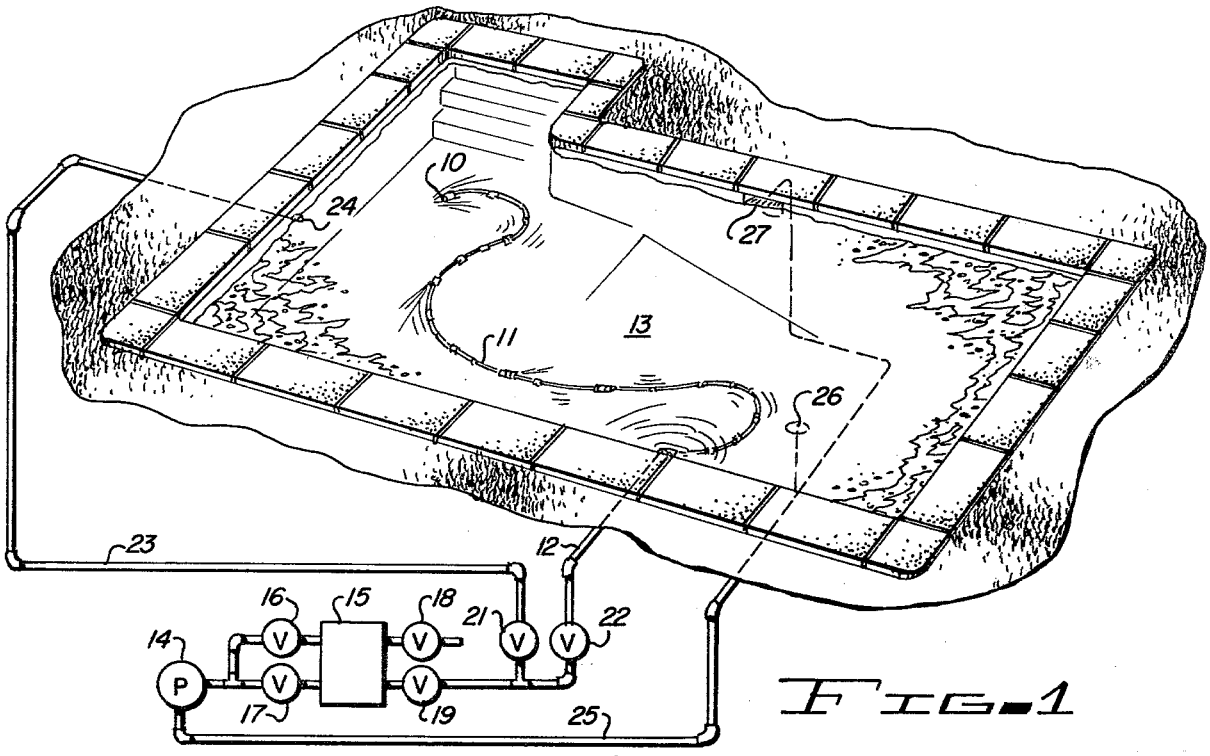
FIG. 1 is a perspective view of a swimming pool in which the cleaning device of the invention has been installed with the pool pump, filter and underground plumbing represented diagrammatically.

Referring more particularly to the drawing by characters of reference, FIGS. 1–10 disclose an improved cleaning device 10 and specially adapted hose 11 of the invention.

FIG. 1 shows the device 10 attached at the end of hose 11, with the other end of hose 11 attached to a water line 12 at the edge of a swimming pool 13. Also shown in FIG. 1 are the conventional components of the swimming pool filtration system including a pump 14, filter 15, valves 16, 17, 18, 19, 21 and 22 and various water lines including the main pressure supply line 23 connected to pool inlet 24 and suction return line 25 connected to the main drain sump 26 and to skimmer outlet 27. In the normal operation of the pool 13, water from pump 14 flows through valve 17, filter 15, valves 19 and 21, line 23 and inlet 24 to the pool 13, then returning via sump 26 and skimmer 27 through line 25, back to pump 14. When valve 22 is opened, a part of the water flow from filter 15 and valve 19 is diverted through valve 22 and line 12 to hose 11 for discharge through cleaning device 10. As the water is discharged from device 10, the reactive force of the discharged water propels the device 10 in a vigorous manner causing it to traverse a random path covering the entire bottom surface of the pool, churning up any dust or debris that may have settled to the bottom so that it is carried with the circulating water through the filter 15.

The device 10, as illustrated most clearly in FIGS. 2, 3, 4 and 5, comprises a generally conically shaped housing 28 having a front portion 29 and a rear or base portion 31.

The front portion 29 is for the most part of a solid plastic material tapering down to a wear resistant tip 32. The tip 32 may be made of brass or some other metal or it may be made of wear resistant plastic with provision for replacement after excessive wear.

The rear or base portion 31 has an interior cylindrical chamber 33 running longitudinally of the housing 28 with four openings to the rear including a central inlet port 34 which is externally threaded for coupling to the hose 11 and including three exhaust ports 35, 36 and 37 arranged symmetrically about inlet port 34. The axis of inlet port 34 is common with that of housing 28 and the exhaust ports 35, 36 and 37 are axially parallel with inlet port 34.

The outer surface of forward portion 29 makes a transition just forward of the center of housing 28 from a conical surface to a cylindrical surface 30, the cylindrical surface 30 extending internally through base portion 31 to form the outer surface of chamber 33, the walls of chamber 33 being integral in the preferred embodiment with forward portion 29 of housing 28.

Figure 4:
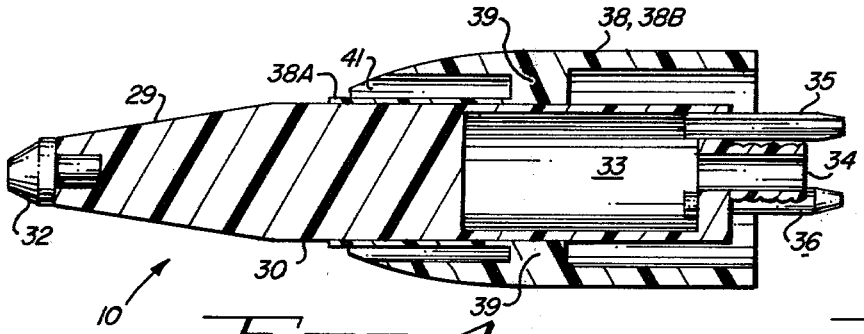
FIG. 4 is a cross-sectional view of the device as seen along line 4—4 of FIG. 3.

Surrounding chamber 33 and forming an outer shell of base portion 31 is a hollow cylindrical shroud 38, the shroud 38 itself having an inner shell 38A and an outer shell 38B. The outer shell 38B extends substantially the full length of shroud 38 while the inner shell 38A extends half way from the front to the rear of shroud 38. Inner shroud 38A is supported coaxially within outer shell 38B by four interconnecting longitudinal webs 39 equally or symmetrically spaced about shell 38A. The inner surface of inner shell 38A fits snugly over the cylindrical surface 30 and is cemented thereto as shown in FIG. 4. The shroud 38 and particularly its outer shell 38A acts as a stabilizer for the trajectory of device 10, functioning in much the same manner in which the similar tail piece found on a torpedo acts to stabilize that device. As device 10 moves forward, water flowing over the tip 32 follows along the conical surface of front portion 29 and then passes through the open space 41 between inner and outer shells 38A and 38B to be exhausted at the base of portion 31 in the area surrounding ports 35, 36 and 37.

Figure 2:
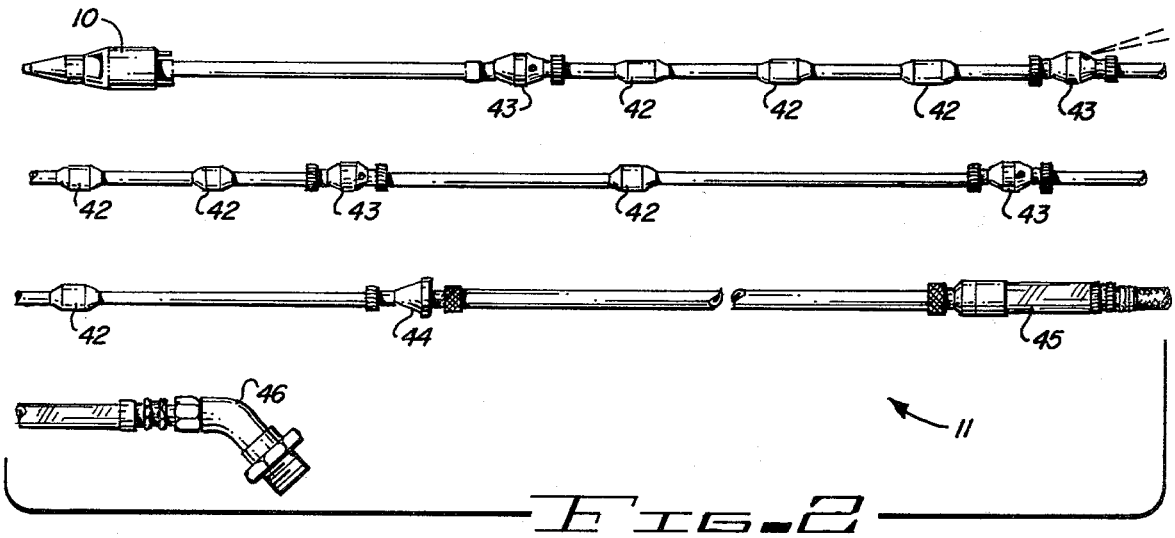
FIG. 2 is a perspective view of the cleaning device of the invention along with the specially designed flexible hose to which it is attached.

As shown in FIGS. 1 and 2, the hose 11 incorporates along its length a number of special couplings and devices including a number of rollers or wear cylinders 42, jet couplings 43, a swivel joint 44, an in-line filter 45 and an end coupling 46.

Figure 6:
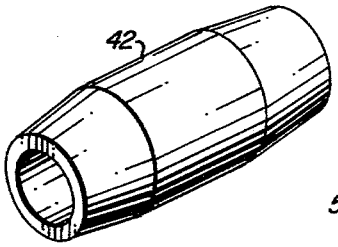
FIG. 6 is an enlarged perspective view of a roller which is slipped over the hose to which the device is attached.

The roller or wear cylinder 42 slips over the flexible hose 11 fitting snugly enough to maintain its position along the length of the hose 11 and serving as a means for holding the hose 11 down on the bottom of the pool while bearing the brunt of the abrasive wear to spare the hose itself as it moves over the floor of the pool. As shown in FIG. 6, roller or wear cylinder 42 is in the general shape of a hollow cylinder tapered at both ends. It is molded from a tough, wear resistant plastic material. Rollers of this type are in common use with other types of pool cleaning devices.

Figure 7:
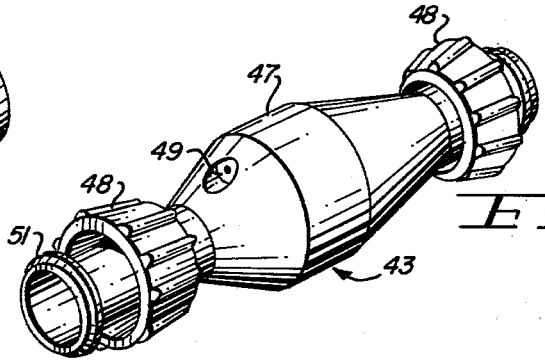
FIG. 7 is an enlarged perspective view of a special jet coupling employed between sections of the hose.
Figure 8:
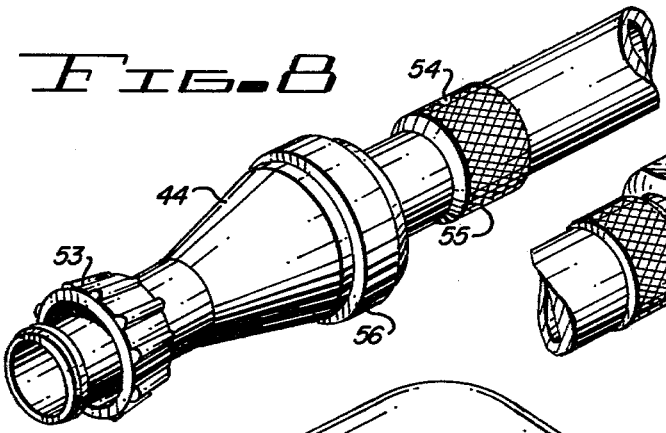
FIG. 8 is an enlarged perspective view of a swivel joint employed near the connection of the hose to the pressurized water source.

The jet coupling 43' as shown most clearly in FIG. 7 comprises a hollow elongated tube with an enlarged cylindrical center section 47 which tapers down at both ends toward hose couplings 48. Extending from the side of one of the tapered ends is an inclined water jet 49 which releases water to produce a lateral thrust against the side of the hose 11, such lateral thrust serving to produce a whipping action. The whipping action of the hose continually alters the direction of device 10 and at the same time enhances the action of hose 11 in its function of agitating the water and the collected dirt at the bottom of the pool. Sections of hose 11 are coupled to jet coupling 43 by slipping the cut end of the hose over the flared end 51 and then threading the hose coupling 48 over the end of the hose. The inside surface of coupling 48 is threaded for this purpose.

Swivel 44 may be any one of several types of swivel joints available for rotatably connecting together two sections of a water hose. A hose coupling 53 identical to the coupling 48 of FIG. 7 is provided for connection to one hose section while a coupling 54 of another type is provided at the other end. Spring pressure from an internal spring holds mating surfaces of swivel 44 in close contact with each other to prevent loss of water at the swivel joint. Except for a metal fitting 55 employed as part of coupling 54, a metal band 56 surrounds the body of swivel 44 and an internal metal spring. The swivel 44 may be constructed of molded plastic parts.

Figure 9:
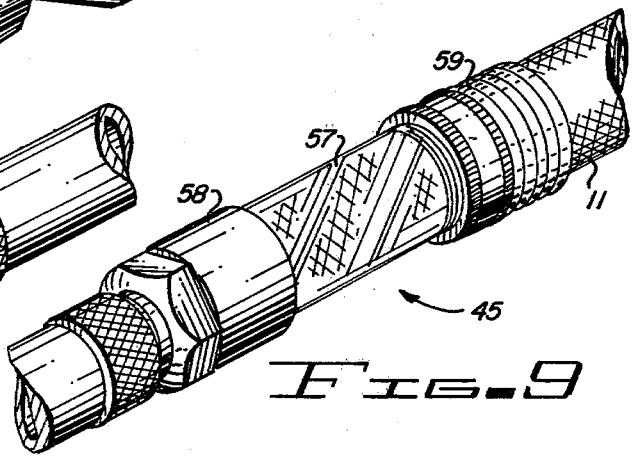
FIG. 9 is an enlarged perspective view of an in-line filter installed between sections of the hose.

The in-line filter 45, as shown in FIG. 9, is a conventional, commercially available filter commonly employed in similar applications to filter out debris which might otherwise clog jets 49 of the jet couplings 47 or jets 35, 36 and 37 of device 10. A transparent plastic center section 57 provides visibility of an internal metal screen contained therein so that the need for cleaning may be readily ascertained. A swivel 58 at one end and a removable coupling 59 at the other end permits the easy disconnection of hose 11 from the coupling end for removal and cleaning of the internal metal screen.

Figure 10:
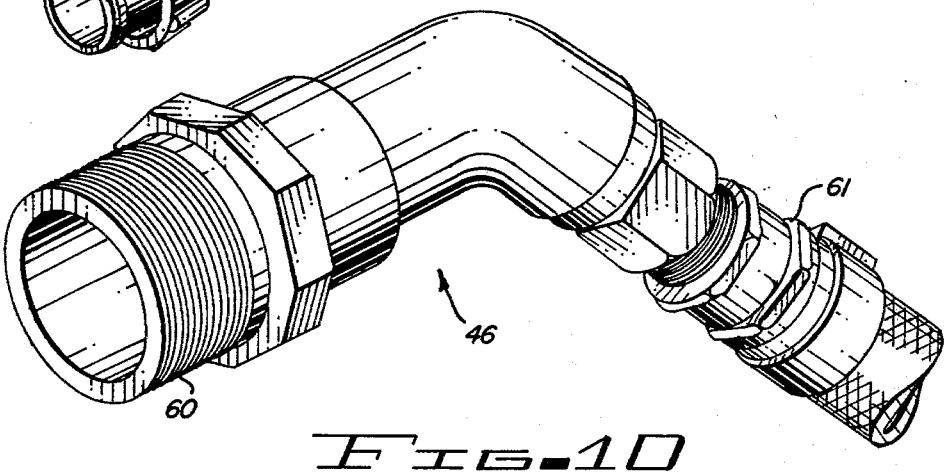
FIG. 10 is an enlarged perspective view of an end coupling employed for connection of the hose to the water pressurized water line at the edge of the pool.

The end coupling 46, as shown most clearly in FIG. 10, is a conventional fitting for adapting hose 11 to the water supply line emerging from the side of the pool. The large threaded end 60 turns into a mating fitting at the end of the water supply line. A detachable coupling 61 at the opposite end permits the disconnection of hose 11.

The uniquely designed device 10 in novel arrangement with rollers or wear cylinders 42, swivel 44, filter 45, end coupler 46 and more importantly with jet coupling 43 strategically positioned along the length of the hose 11 comprises a particularly effective cleaning device for swimming pools in accordance with the stated objects of the invention. Water under pressure from line 12 enters hose 11 and is carried by hose 11 to inlet port 34 of device 10 through which it enters chamber 33. From chamber 33, the water is discharged rewarwardly of device 10 through jets 35, 36 and 37. The reactive force produced by the discharging water drives device 10 forward with sufficient force that it moves rapidly along the bottom of the pool dragging with it hose 11. Water discharging simultaneously from jets 49 of the several jet couplings 43 located strategically along the length of hose 11 enhances the tendency of the hose to whip from side to side in a serpentine fashion, such whipping action constantly altering the direction taken by device 10 while at the same time agitating the water and settled debris along the entire length of the pool, such agitating action being supplementary to the agitation produced by the water discharged through jets 35, 36 and 37 of device 10 and to a lesser degree, also by the water discharged from jets 49 of jet couplings 43. Because there are no internal moving parts in device 10, the initial cost is low and maintenance is limited to the replacement of overworn parts.

It should also be recognized that the claimed agitating device may be added to the pool pressurized filtering system without increasing the size of its pump thereby eliminating the additional pumping needs of prior art agitating systems.

Figure 3:
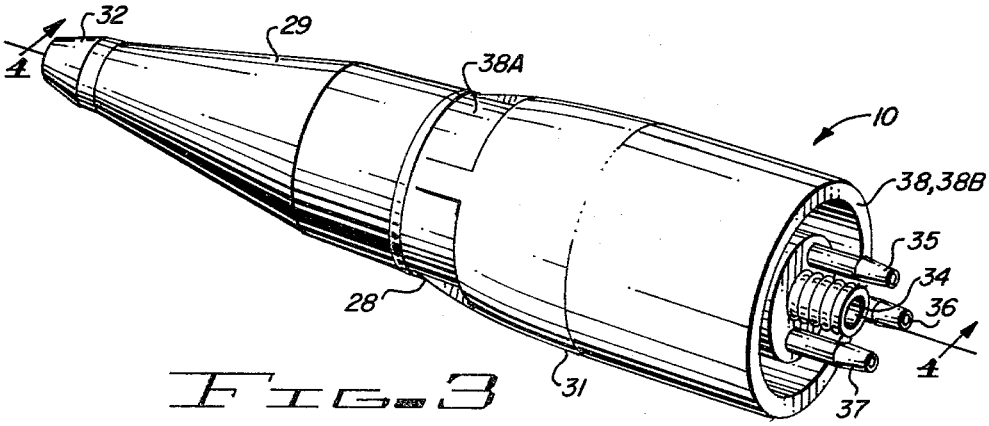
FIG. 3 is an enlarged perspective view of the cleaning device shown unattached to the hose.
Figure 5:
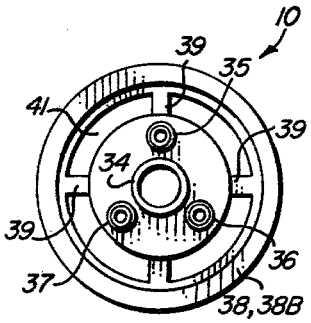
FIG. 5 is an end view of the device of FIG. 3 as viewed from the end which attaches to the hose.
Figure 11:
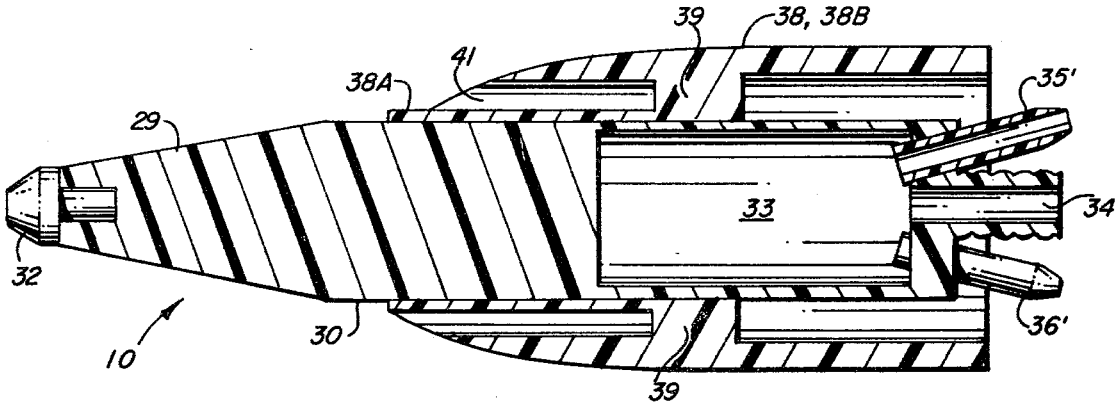
FIG. 11 is a cross-sectional view of a modification of the cleaning device shown in FIGS. 3, 4 and 5.
Figure 12:
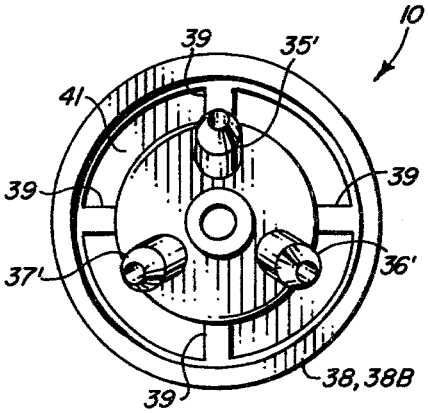
FIG. 12 is a right end view of the complete device shown in FIG. 11.

FIGS. 11 and 12 disclose a modification of the cleaning device shown in FIGS. 3, 4 and 5 wherein like parts are given the same reference characters. The only difference between the modified cleaning device and that shown in FIGS. 3–5 is that jets 35', 36' and 37' are arranged at acute angles with inlet port 34 of the cleaning device. Although jets 35', 36' and 37' are all arranged at substantially the same angle with inlet port 34, variations of this angle of given jets with inlet port 34 may be provided and still fall within the scope of this invention.

Although but two embodiments of the invention have been illustrated and described, it will be apparent to those skilled in the art that various changes and modifications may be made therein without departing from the spirit of the invention or from the scope of the appended claims.

What is claimed is:

1. A cleaning device for swimming pools comprising:

a generally conical shaped housing comprising a first portion forming the tip of the housing and a second portion the base of the housing, said base portion defining a first fluid conduit arranged axially along at least a part of its length which is open at the base of the base portion for connection to an elongated flexible conduit which is connectable to a source of water under pressure, said base portion further defining a plurality of second fluid conduits spacedly arranged around said first fluid conduit, one end of each of said second fluid conduits terminating in a nozzle adjacent the base of said base portion, and means for connecting the other end of said first fluid conduit with each of the other ends of said second fluid conduits interiorally of said base portion, whereby water under pressure passing through said first fluid conduit from said one end to its other end thereof and through said second fluid conduits causes said cleaning device to move through the water in a swimming pool while dragging the flexible conduit behind it.

2. The cleaning device set forth in claim 1 wherein:

said second fluid conduits are spacedly arranged around said first fluid conduit in a parallel arrangement.

3. The cleaning device set forth in claim 1 wherein:

said second fluid conduits are arranged to extend laterally from said first fluid conduit.

4. The cleaning device set forth in claim 1 wherein:

said second fluid conduits are arranged to extend laterally from said first fluid conduit all at substantially the same acute angle therewith.

5. The cleaning device set forth in claim 1 in further combination with:

a hollow chamber arranged within said housing in communication with said other end of said first fluid conduit and said other ends of said second fluid conduits, said hollow chamber serving as a reservoir for water under pressure passing through said first fluid conduit and into said second fluid conduits.

6. The cleaning device set forth in claim 1 wherein:

said base is provided with open ended passageways extending therethrough longitudinally thereof around its periphery downstream of the apex of said housing for stablizing it as it moves through the water.

7. The cleaning device set forth in claim 1 wherein:

said tip portion is heavier than said base portion.

8. The cleaning device set forth in claim 7 wherein:

said tip is formed of wear resistant material and is detachably connected to first member.

9. The cleaning device set forth in claim 1 in further combination with:

a flexible conduit connected at one end to said first fluid conduit and connectable at its other end to a source of water under pressure, said conduit comprising at least two parts interconnected by a swivel joint, said joint provided with a passageway for water flow from the hollow interior of said conduit through said joint for providing a lateral thrust against the side of the hose.

10. The cleaning device set forth in claim 9 wherein:

said flexible conduit further comprises a portion comprising a water filtering means within its hollow interior.

* * * * *